US006932032B2

(12) United States Patent
Lingen et al.

(10) Patent No.: US 6,932,032 B2
(45) Date of Patent: Aug. 23, 2005

(54) TWO-STROKE ENGINE

(75) Inventors: Andreas Lingen, Allmersbach (DE); Matthias Hehnke, Schorndorf (DE); Joachim Baumhauer, Schwäbisch Gmünd (DE); Andreas Bähner, Weinstadt (DE); Michael Joos, Fellbach (DE); Axel Klimmek, Schwaikheim (DE); Hans Holderle, Freiberg (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 10/986,115

(22) Filed: Nov. 12, 2004

(65) Prior Publication Data

US 2005/0098124 A1 May 12, 2005

(30) Foreign Application Priority Data

Nov. 12, 2003 (DE) ..... 103 52 808

(51) Int. Cl.[7] ..... F02B 33/04
(52) U.S. Cl. ..... 123/73 A; 123/73 PP; 123/65 V
(58) Field of Search ..... 123/73 R, 73 A, 123/73 PP, 65 V

(56) References Cited

U.S. PATENT DOCUMENTS 5,870,981 A * 2/1999 Knaus et al. ..... 123/65 A
6,712,029 B1 3/2004 Andersson et al.
2002/0073943 A1 * 6/2002 Geyer et al. ..... 123/73 B
2003/0200941 A1 * 10/2003 Schlossarczyk et al. . 123/73 PP
2005/0045123 A1 * 3/2005 Klaric ..... 123/73
2005/0051118 A1 * 3/2005 Hoche et al. ..... 123/73 A

* cited by examiner

*Primary Examiner*—John T. Kwon
(74) *Attorney, Agent, or Firm*—Walter Ottesen

(57) ABSTRACT

A two-stroke engine (1) has a combustion chamber (3) disposed in a cylinder (2). The combustion chamber (3) is delimited by a reciprocating piston (5). The piston (5) drives a crankshaft (7) via a connecting rod (6) and the crankshaft (7) is rotatably journalled in a crankcase (4). The two-stroke engine (1) has an intake channel (8) for the supply of fuel into the crankcase (4), an outlet (13) for exhaust gases from the combustion chamber (3) and an air channel (10) for the supply of substantially fuel-free air. A throttle element (18) is mounted in the air channel (10). At pregiven positions of the piston (5), the crankcase (4) is connected via at least one transfer channel (14) to the combustion chamber (3). In order to prevent air from being drawn by suction into the air channel because of leakages during idle or at low rpm, a fluid connection is provided between the air channel (10) downstream of the throttle element (18) and the crankcase (4) for underpressure compensation which connection is present at least partially for a position of the piston from 90° ahead of bottom dead center to 90° after bottom dead center. A connection between the crankcase (4) and the intake channel (8) can be provided in lieu of, or in addition to, the connection to the air channel (10).

15 Claims, 3 Drawing Sheets

TWO-STROKE ENGINE

CROSS REFERENCE TO RELATED APPLICATION

This application claims priority of German patent application no. 103 52 808.3, filed Nov. 12, 2003, the entire content of which is incorporated herein by reference.

FIELD OF THE INVENTION

The invention relates to a two-stroke engine including a two-stroke engine in a portable handheld work apparatus such as a motor-driven chain saw, cutoff machine or the like.

BACKGROUND OF THE INVENTION

U.S. Pat. No. 6,712,029 discloses a two-stroke engine wherein substantially fuel-free air is supplied from an air channel to the transfer channels via a piston window. In the air channel, a throttle flap is provided for controlling the supplied air quantity. The throttle flap is completely or at least substantially closed during idle and during low engine load. An underpressure is formed in the air channel section downstream of the throttle flap because of the substantially closed throttle flap. The underpressure causes ambient air or air from the air channel section upstream of the throttle flap to be drawn by suction through leaks in the channel. A reliable sealing of the air channel can be achieved only with great complexity for a throttle flap which is substantially closed.

SUMMARY OF THE INVENTION

It is an object of the invention to provide a two-stroke engine of the kind described wherein a favorable ratio of air and fuel can be made available with little complexity in each operating state.

The two-stroke engine of the invention is for an engine in a portable handheld work apparatus and includes: a cylinder having a cylinder wall; a piston mounted in the cylinder to undergo a reciprocating movement along a stroke path between top dead center and bottom dead center during operation of the engine; the cylinder and the piston conjointly delimiting a combustion chamber; a crankcase connected to the cylinder; a crankshaft rotatably mounted in the crankcase; a connecting rod connecting the piston to the crankshaft to permit the piston to drive the crankshaft as the piston reciprocates in the cylinder; an outlet for conducting exhaust gases away from the combustion chamber; a first channel for supplying fuel to the crankcase; a second channel for supplying substantially fuel-free air to the engine; first and second throttle flaps movably mounted in the first and second channels, respectively; a transfer channel for connecting the crankcase to the combustion chamber at predetermined positions of the piston; and, means for establishing at least partially a fluid connection connecting at least one of the first and second channels from a location downstream of the throttle flap corresponding thereto to the crankcase when one of the throttle flaps substantially closes the channel corresponding thereto and when the piston is disposed at a position within the range of from 90° ahead of bottom dead center to 90° after bottom dead center.

A higher pressure is present in the crankcase than in the air channel closed by the throttle element in a region between approximately 90° ahead of bottom dead center and up to 90° after bottom dead center of the piston. A pressure compensation can take place between the air channel and the crankcase via the connection between the air channel and the crankcase. No ambient air is any longer drawn in by suction because the pressure level in the air channel downstream of the throttle flap is increased. A leaning of the mixture because of the additionally inducted and substantially fuel-free air into the air channel can be avoided in this way in a simple manner. An increase of the pressure level can be realized also via the connection between the crankcase and the intake channel. The pressure level in the intake channel is increased via the connection when the inlet of the intake channel is closed. For this reason, less fresh gas flows through the carburetor into the intake channel in this phase. In order to ensure the required charge of the intake channel, the throttle flap can be opened further in the intake channel. In this way, the requirements as to seal tightness on the throttle flap in the intake channel and on the throttle element in the air channel are reduced.

The connection advantageously is present at bottom dead center of the piston. It is practical that the connection between the supply channel and the crankcase is present at each position of the piston. However, it can be practical that the connection is controlled in dependence upon the position of the piston. A simple configuration results when the connection is slot controlled via the piston. In this way, it can be ensured that the connection is present only in a range of approximately between 90° ahead of bottom dead center and 90° after bottom dead center.

The connection is controlled via at least one valve. The connection is controlled in dependence upon the engine load. In this way, it can be ensured that the connection is only present at idle or at low loads. In these cases, the throttle element is substantially closed. At high engine loads, the throttle element is substantially opened so that an underpressure compensation is not necessary. The position of the valve is especially controlled in dependence upon the position of the throttle element. However, it can be practical that the connection is present independently of the engine load. The connection is advantageously configured in a connecting channel. The connecting channel opens at the cylinder bore and the opening is connected to the crankcase via a piston window in the piston in the region of bottom dead center.

The flow cross section in the connecting channel is at most a third of the flow cross section in the intake channel. In this way, it is ensured that only a pressure compensation is achieved via the connecting channel. Essential mass flows in the connecting channel can thereby be avoided. A throttle is mounted in the connecting channel in order to compensate for pressure fluctuations in the connecting channel. The connection is advantageously configured as a slot in the cylinder wall. In this way, a simple configuration of the connection results.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
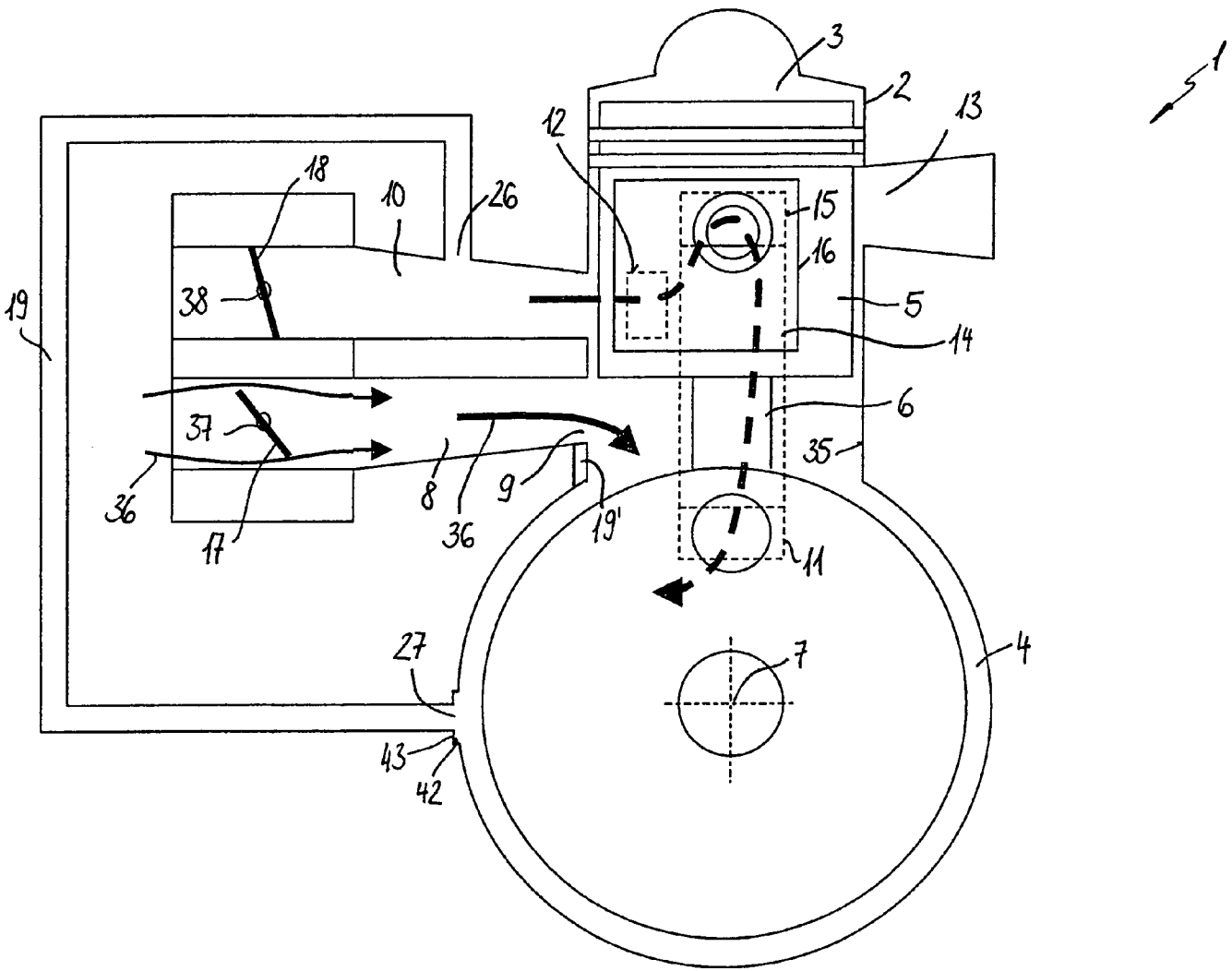
FIG. 1 is a schematic of a two-stroke engine at idle according to a first embodiment of the invention.

The two-stroke engine 1 shown in FIG. 1 includes a cylinder 2 wherein a combustion chamber 3 is formed. The combustion chamber 3 is delimited by a piston 5. The piston 5 is journalled in the cylinder 2 so as to be displaceable in the longitudinal direction. The piston 5 rotatingly drives a crankshaft 7 via the connecting rod 6 and the crankshaft 7 is rotatably journalled in the crankcase 4. The two-stroke engine 1 includes an intake channel 8 which opens with an inlet 9 at the cylinder bore 35. The inlet 9 of the intake channel 8 is slot controlled by the piston 5. In the intake channel 8, a throttle flap 17 is pivotally journalled about a throttle shaft 37. The throttle flap 17 can be mounted in a carburetor wherein an air/fuel mixture is prepared. In dependence upon the position of the throttle flap 17, an air/fuel mixture flows in the direction of arrows 36 through the intake channel 8 and into the crankcase 4 as long as the inlet 9 is cleared by the piston 5.

An air channel 10 opens with an air window 12 at the cylinder 2. In the region of top dead center of the piston 5, the air window 12 is connected to a transfer window 15 of a transfer channel 14 via a piston window 16 formed in the piston 5. In the region of top dead center of the piston 5, substantially fuel-free air can flow from the air channel 10 via the transfer channel 14 into the crankcase 4. At pregiven positions of the piston, the transfer channel 14 connects the crankcase 4 to the combustion chamber 3 and opens into crankcase 4 via a transfer opening 11.

In the air channel 10, an air flap 18 is mounted which is pivotally journalled about an air flap shaft 38. Downstream of the air flap 18, a connecting channel 19 opens with a first opening 26 into the air channel 10. The other end of the connecting channel 19 opens with a second opening 27 into crankcase 4. The opening 27 is arranged in the base 43 of a pocket 42 recessed from the wall of the crankcase 4. In this way, it is avoided that fuel, which collects on the wall of the crankcase 4, can arrive unhindered in the connecting channel 19. The pocket 42 can have a cover. The flow cross section in the connecting channel 19 amounts to at most one-third of the flow cross section in the intake channel 8.

During operation of the two-stroke engine 1, an air/fuel mixture flows in the direction of arrows 36 into the crankcase 4 in the region of top dead center of the piston 5. For a partially opened air flap 18, substantially fuel-free air flows simultaneously from the air channel 10 via the transfer channel 14 into the crankcase 4. For a movement of the piston 5 in the direction toward the crankcase 4, the transfer window 15 is opened to the combustion chamber 3 so that the air/fuel mixture from the crankcase 4 can flow via the transfer channel 14 into the combustion chamber 3.

The air/fuel mixture is compressed for the subsequent movement of the piston 5 in the direction toward the combustion chamber 3 and is ignited in the combustion chamber 3 by a spark plug (not shown). With the following movement toward the crankcase 4, the piston 5 clears an outlet 13 from the cylinder 2 through which the exhaust gases are discharged from the cylinder 2. For a further downward movement of the piston 5, at first substantially fuel-free air flows through the transfer channel 14 and, thereafter, the air/fuel mixture flows into the combustion chamber 3 from the crankcase 4.

The air flap 18 substantially closes the air channel 10 in the idle position shown in FIG. 1. In this way, an underpressure develops in the air channel 10 in the region of bottom dead center of the piston 5. The underpressure in the air channel 10 can be compensated from the crankcase 4 via the connecting channel 19. At most an insignificant flow of the air/fuel mixture takes place from the crankcase 4 into the air channel 10. Because of the reduction of the underpressure in the air channel 10, the condition is avoided that air is drawn by suction into the air channel 10 from the ambient or from upstream of the air flap 18. This air could flow via the transfer channel 14 into the crankcase 4 and thereby could lead to an increased leaning of the air/fuel mixture in the crankcase 4. The connecting channel 19 is open for each position of the piston 5 and independently of the engine load, that is, independently of the position of the throttle flap 17 and the air flap 18. Since no significant underpressure develops in the air channel 10 for an opened air flap 18, no significant pressure compensation takes place at high loads and high engine speeds via the connecting channel 19.

In lieu of, or in addition to the connecting channel 19, a connecting channel 19' can be provided which connects the intake channel 8 to the crankcase 4. In the embodiment shown, the connecting channel 19' is configured as a slot in the cylinder wall and this slot extends from the inlet 9 to the crankcase 4. The connecting channel 19' can, however, also be configured as an outside-lying channel. The connecting channel 19' can be controlled by the piston 5 or by a valve; however, the intake channel 8 can be connected via the connecting channel 19' also continuously to the crankcase 4. The configuration of the connecting channel 19' can correspond to that of the connecting channel 19. A throttle can be mounted in the connecting channel 19'.

Figure 2:
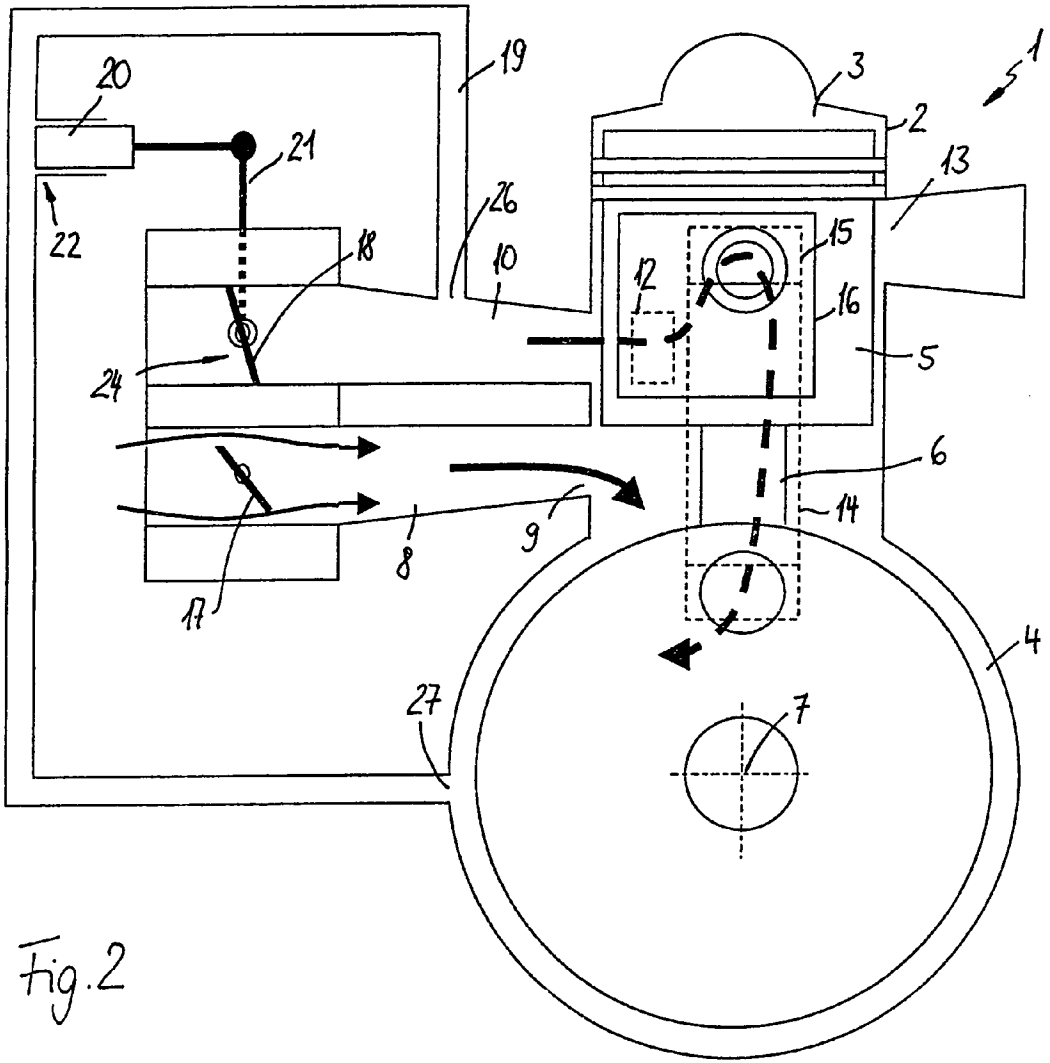
FIG. 2 is a schematic of a two-stroke engine at idle according to a second embodiment of the invention.

The two-stroke engine 1, which is shown in FIG. 2, corresponds essentially to the two-stroke engine shown in FIG. 1. The same reference numerals identify like components. In the connecting channel 19, a valve 20 is mounted which is shown in its open position 22 in FIG. 2. The valve 20 is coupled to the air flap 18 via a linkage or coupling 21. In FIG. 2, the air flap is in the closed position 24 so that the air channel 10 is closed substantially air-tight by the air flap 18. In the closed position 24 of the air flap 18, the connecting channel 19 is opened so that a pressure compensation can take place between the crankcase 4 and the air channel 10 in the region downstream of the air flap 18.

Figure 3:
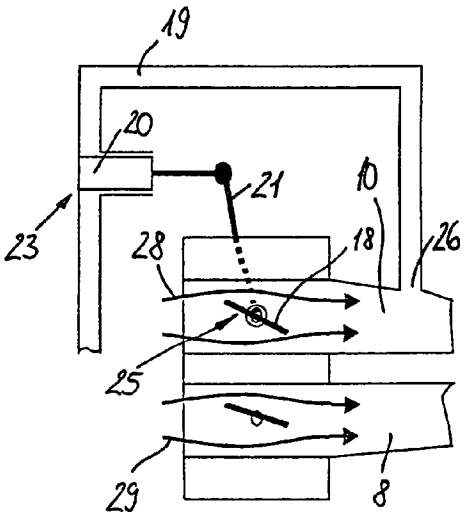
FIG. 3 is a detailed view of FIG. 2 at part load.

In FIG. 3, the air flap 18 is shown in a substantially opened position. The coupling 21 is shown, for example, as a lever. Via the coupling 21, the valve 20 can be brought into its closed position 23. The connecting channel 19 is thereby substantially sealed closed by the valve 20 so that no pressure compensation can take place between the air channel 10 downstream of the air flap 18 and the crankcase 4. Substantially fuel-free air flows in the air channel 10 in the flow direction 28 with respect to which the designation "downstream" refers. In the intake channel 8, an air/fuel mixture flows in flow direction 29 to the crankcase 4. The connecting channel 19 thereby forms a connection between the air channel 10 and the crankcase 4 only when the air flap 18 is in the closed position 24 or in a substantially closed position.

Figure 4:
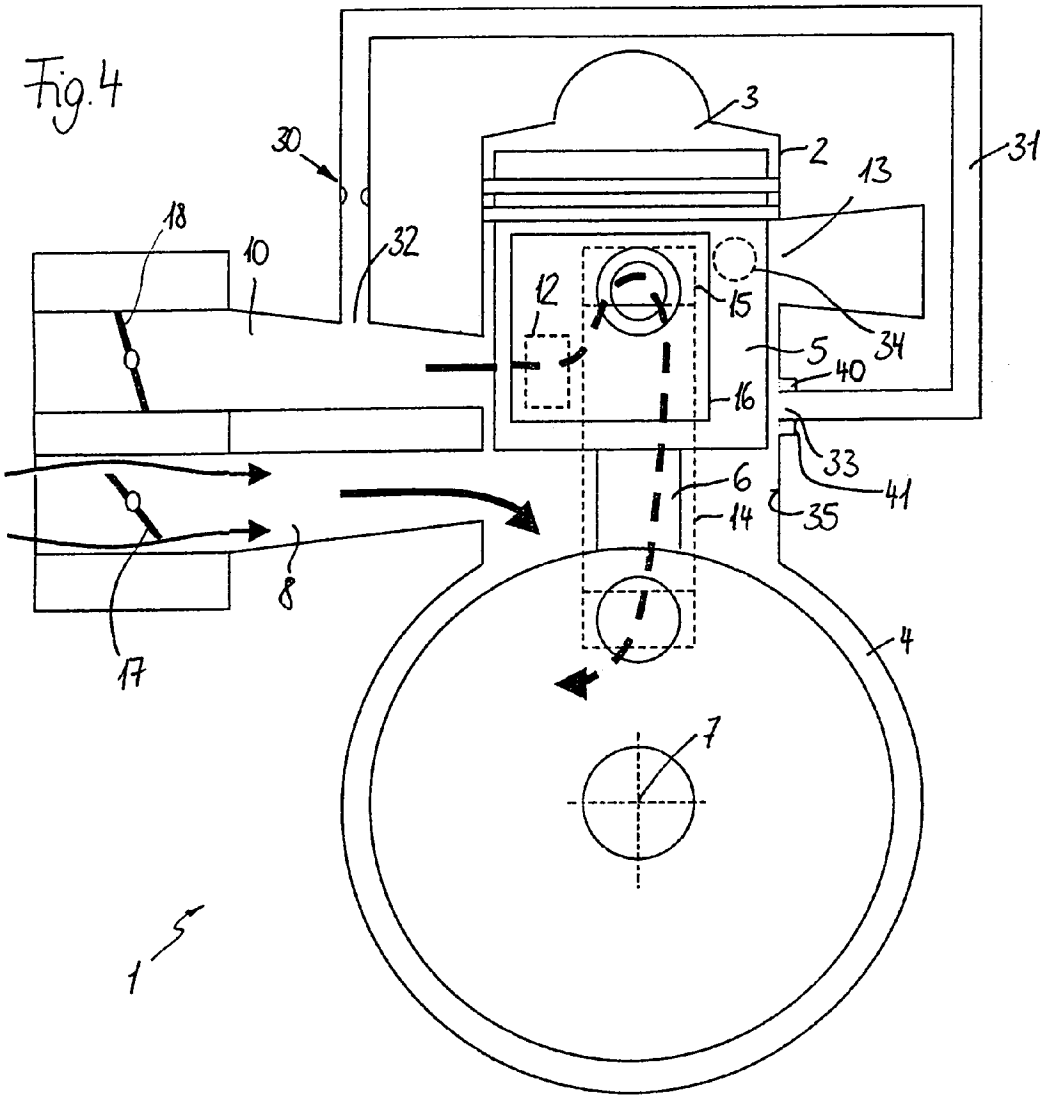
FIG. 4 is a schematic of a two-stroke engine at idle with the piston at top dead center; and, FIG. 5 is a detail of FIG. 4 with the piston at bottom dead center.

The two-stroke engine 1 shown in FIG. 4 has a connecting channel 31 which opens into the air channel 10 with a first opening 32 downstream of the air flap 18 and opens with a second opening 33 at the cylinder bore 35. The second opening 33 is thereby slot controlled by the piston 5. The second opening 33 is arranged in a recessed pocket 40 in the cylinder wall. The connecting channel 31 projects beyond the base 41 of the pocket 40 up to almost the elevation of the cylinder wall so that the pocket 40 advantageously forms an annular slot about the opening 33 recessed with respect to the cylinder wall. Fuel can collect in the annular slot. In this way, the condition is avoided that fuel from the cylinder wall can reach the opening 33. The piston 5 has a piston window 34 in a region which passes over the second opening 33. The piston window 34 is configured as an opening from the piston surface into the piston interior.

Figure 5:
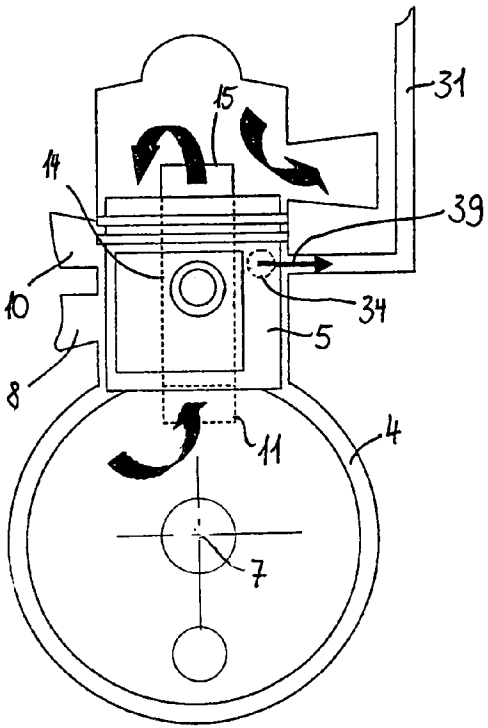

As shown schematically in FIG. 5, the crankcase 4 is connected to the connecting channel 31 via the piston window 34 in the region of bottom dead center of the piston 5 so that a pressure compensation between the crankcase 4 and the air channel 10 can take place in the direction of the arrow 39.

The piston window 34 is so arranged that a connection is present between the crankcase 4 and the air channel 10 in a region wherein the piston is disposed between 90° ahead of bottom dead center and 90° after bottom dead center. Advantageously, the connection is present in a region wherein the piston is 600 ahead of bottom dead center up to 600 after bottom dead center and especially in the region of bottom dead center. The degree amount here relates to the revolution angle of the crankshaft 7. In order to compensate pressure fluctuations in the connecting channel 31, a throttle 30 is provided in the connecting channel 31 and this throttle is shown in FIG. 4. The piston window 34 can also be configured as a slot on the piston skirt via which a connection is established between the connecting channel 31 and the crankcase 4.

It is understood that the foregoing description is that of the preferred embodiments of the invention and that various changes and modifications may be made thereto without departing from the spirit and scope of the invention as defined in the appended claims.

What is claimed is:

1. A two-stroke engine including an engine in a portable handheld work apparatus, the two-stroke engine comprising:

a cylinder having a cylinder wall;

a piston mounted in said cylinder to undergo a reciprocating movement along a stroke path between top dead center and bottom dead center during operation of said engine;

said cylinder and said piston conjointly delimiting a combustion chamber;

a crankcase connected to said cylinder;

a crankshaft rotatably mounted in said crankcase;

a connecting rod connecting said piston to said crankshaft to permit said piston to drive said crankshaft as said piston reciprocates in said cylinder;

an outlet for conducting exhaust gases away from said combustion chamber;

a first channel for supplying fuel to said crankcase;

a second channel for supplying substantially fuel-free air to said engine;

first and second throttle flaps movably mounted in said first and second channels, respectively;

a transfer channel for connecting said crankcase to said combustion chamber at predetermined positions of said piston; and, means for establishing at least partially a fluid connection connecting at least one of said first and second channels from a location downstream of the throttle flap corresponding thereto to said crankcase when one of said throttle flaps substantially closes the channel corresponding thereto and when said piston is disposed at a position within the range of from 90° ahead of bottom dead center to 90° after bottom dead center.

2. The two-stroke engine of claim 1, wherein said connection is present when said piston is at bottom dead center.

3. The two-stroke engine of claim 1, wherein said connection is present at every position of said piston.

4. The two-stroke engine of claim 1, wherein said establishing means includes means for controlling said connection in dependence upon the position of said piston.

5. The two-stroke engine of claim 4, wherein said connection is slot controlled via said piston.

6. The two-stroke engine of claim 1, wherein said connection is controlled via at least one valve.

7. The two-stroke engine of claim 6, wherein said connection is controlled in dependence upon engine load.

8. The two-stroke engine of claim 6, wherein the position of said valve is controlled in dependence upon said second throttle flap in said second channel.

9. The two-stroke engine of claim 1, wherein said connection is established independently of the engine load.

10. The two-stroke engine of claim 1, wherein said fluid connection is formed as a connecting channel.

11. The two-stroke engine of claim 10, wherein said connecting channel opens at the bore of said cylinder whereat said connecting channel defines an opening; said piston has a piston window formed therein; and, said opening of said connecting channel is connected via said piston window to said crankcase when said piston is in the region of bottom dead center thereof.

12. The two-stroke engine of claim 11, wherein said cylinder has a cylinder wall defining a pocket; and, said opening of said connecting channel is disposed in said pocket.

13. The two-stroke engine of claim 10, wherein said connecting channel has a flow cross section which is at most one-third of the cross section of said first channel.

14. The two-stroke engine of claim 10, wherein said connecting channel has a throttle formed therein.

15. The two-stroke engine of claim 1, wherein said fluid connection is formed as a slot in the wall of said cylinder.

* * * * *

UNITED STATES PATENT AND TRADEMARK OFFICE

CERTIFICATE OF CORRECTION

PATENT NO. : 6,932,032 B2
DATED : August 23, 2005
INVENTOR(S) : Andreas Lingen et al.

It is certified that error appears in the above-identified patent and that said Letters Patent is hereby corrected as shown below:

Column 5,
Line 17, delete the first and second "(600)" and substitute -- (60°) -- therefor.

Signed and Sealed this

Eighth Day of November, 2005

JON W. DUDAS
*Director of the United States Patent and Trademark Office*